US006858101B1

(12) United States Patent
Hashimura et al.

(10) Patent No.: US 6,858,101 B1
(45) Date of Patent: Feb. 22, 2005

(54) STEEL EXCELLENT IN FORGEABILITY AND MACHINABILITY

(75) Inventors: Masayuki Hashimura, Muroran (JP); Hiroshi Hirata, Muroran (JP); Kohichi Isobe, Muroran (JP); Ken-ichiro Naito, Muroran (JP); Kenji Fukuyasu, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 8 days.

(21) Appl. No.: 10/221,119

(22) PCT Filed: Sep. 7, 2000

(86) PCT No.: PCT/JP00/06108

§ 371 (c)(1),
(2), (4) Date: Sep. 6, 2002

(87) PCT Pub. No.: WO01/66814

PCT Pub. Date: Sep. 13, 2001

(30) Foreign Application Priority Data

Mar. 6, 2000 (JP) ..... 2000-060199

(51) Int. Cl.[7] ..... C22C 38/14; C22C 38/02; C22C 38/04

(52) U.S. Cl. ..... 148/320; 148/330; 148/333; 148/336; 420/87; 420/88

(58) Field of Search ..... 148/320, 330, 148/333, 336, 328; 420/87, 88, 125

(56) References Cited

U.S. PATENT DOCUMENTS 4,434,006 A 2/1984 Kato et al.

FOREIGN PATENT DOCUMENTS

| | | | | |
|---|---|---|---|---|
| JP | 49-66522 | | 6/1974 | |
| JP | 358055553 | * | 4/1983 | ..... C22C/38/14 |
| JP | 62-207821 | | 9/1987 | |
| JP | 01-165749 | | 6/1989 | |
| JP | 402047240 | * | 2/1990 | ..... C22C/38/14 |
| JP | 03-2351 | | 1/1991 | |
| JP | 4-135088 | | 5/1992 | |
| JP | 07-3390 | | 1/1995 | |
| JP | 07-188846 | | 7/1995 | |

* cited by examiner

*Primary Examiner*—Deborah Yee
(74) *Attorney, Agent, or Firm*—Kenyon & Kenyon

(57) ABSTRACT

The present invention is a steel, excellent in machinability, wherein forging workability is improved by suppressing the deterioration of mechanical properties in the direction in which the mechanical properties are the lowest, and more specifically, is a steel excellent in forgeability and machinability, characterized in that: the steel contains, in mass, C: 0.1 to 0.85%, Si: 0.01 to 1.5%, Mn: 0.05 to 2.0%, P: 0.003 to 0.2%, S: 0.003 to 0.5%, and Zr: 0.0003 to 0.01%; the following steel components are controlled in the following ranges respectively, in mass, Al: 0.01% or less, total O: 0.02% or less, and total N: 0.02% or less; the average aspect ratio of MnS grains is 10 or less and the maximum aspect ratio of those is 30 or less; and the balance of the steel components consists of Fe and unavoidable impurities.

21 Claims, 7 Drawing Sheets

STEEL EXCELLENT IN FORGEABILITY AND MACHINABILITY

TECHNICAL FIELD

This invention relates to a steel used for cars, general machinery and so on and, in particular, to a steel excellent in hot forgeability and machinability.

BACKGROUND ART

In recent years, while the strengthening of steels has been advancing, the workability thereof has been deteriorating, and, as a consequence, demands for a steel which is excellent in forgeability and machinability have been growing. Common measures to improve efficiency in hot forging have hitherto been to decrease inclusions, to add elements which enhance high temperature ductility, and to decrease the amounts of elements which lower high temperature ductility. In the meantime, it has been known that the addition of elements to improve machinability such as S and Pb is effective for improving machinability. However, as the elements effective for improving machinability deteriorate high temperature ductility, it is difficult to obtain good hot forgeability and good machinability at the same time. For instance, Pb and Bi are considered to improve machinability while having a comparatively small adverse influence on forgeability, but it is known that they deteriorate high temperature ductility. S improves machinability by forming inclusions such as MnS grains which soften under machining conditions but the gains of MnS are large compared with the grains of Pb and so on and, therefore, they are likely to be the origin of stress concentration. When MnS grains are stretched by forging or rolling, in particular, they cause anisotropy in mechanical properties and the steel strength is significantly lowered in a specific direction. For this reason, it is necessary to pay attention to the anisotropy at a design stage. Therefore, in this case, a technology for minimizing the anisotropy caused by the elements to render free-cutting properties is required. Further, P is known to improve machinability, but it cannot be added in a large amount because it is likely to cause cracks during casting and, for this reason, there is a limit to the machinability improvement effect of P. Some researchers maintain that an addition of Te is effective for solving the problem of anisotropy (for instance, Japanese Unexamined Patent Publication No. S55-41943), but Te is likely to cause cracks during casting, rolling and forging.

Besides the above, Japanese Unexamined Patent Publication No. S49-66522 discloses a technology of attempting to improve machinability of a steel in a wide range of cutting speeds, from low-speed cutting to high-speed cutting, through an addition of a deoxidizing agent containing Zr and Ca. In this technology, however, the problem of the fracture caused by MnS grains stretched during rolling or forging remains unsolved.

In this situation, further technical innovation is required for realizing both high hot ductility and good machinability at the same time.

DISCLOSURE OF THE INVENTION

The object of the present invention is to provide a steel excellent in hot ductility and machinability to cope with the above problems.

In general, a steel is subjected to working during rolling and forging, and the anisotropy of mechanical properties occurs as a result of the plastic flow during the working process. The occurrence of cracks resulting from the anisotropy poses a substantial limit to forging work. For improving forgeability, therefore, it is effective to shape inclusions such as MnS grains as spherically as possible and, by this, minimize the anisotropy. Further, even if anisotropy occurs, if the size of the inclusions is small, the adverse effects of the anisotropy are minimized. For this end, it is desirable to so control a steel chemical composition so as to disperse MnS, which improves machinability, in fine gains and keep their shapes spherical.

The present invention is a steel excellent in forgeability and machinability, which is accomplished based on the above findings, and the gist is as follows:

(1) A steel excellent in forgeability and machinability, characterized in that:
the steel contains, in mass,
C: 0.1 to 0.85%,
Si: 0.01 to 1.5%,
Mn: 0.05 to 2.0%,
P: 0.003 to 0.2%,
S: 0.003 to 0.5%, and
Zr: 0.0003 to 0.01%;
the following steel components are controlled in the following ranges respectively, in mass,
Al: 0.01% or less,
total O: 0.02% or less, and
total N: 0.02% or less;
the average aspect ratio of MnS grains is 10 or less and the maximum aspect ratio of those is 30 or less; and
the balance of the steel components consists of Fe and unavoidable impurities.

(2) A steel excellent in forgeability and machinability, characterized in that:
the steel contains, in mass,
C: 0.1 to 0.85%,
Si: 0.01 to 1.5%,
Mn: 0.05 to 2.0%,
P: 0.003 to 0.2%,
S: 0.003 to 0.5%, and
Zr: 0.0003 to 0.01%;
the following steel components are controlled in the following ranges respectively, in mass,
Al: 0.01% or less,
total 0: 0.02% or less, and
total N: 0.02% or less;
the average aspect ratio of MnS grains is 10 or less and the maximum aspect ratio of those is 30 or less;
further, the maximum grain size ($\mu$m) of MnS is equal to or less than 110×[S%]+15 and the number of the MnS grains per $mm^2$ is equal to or more than 3,800×[S %]+150; and
the balance of the steel components consists of Fe and unavoidable impurities.

(3) A steel characterized in that:
the steel contains, in mass,
C: 0.1 to 0.85%,
Si: 0.01 to 1.5%,
Mn: 0.05 to 2.0%,
P: 0.003 to 0.2%,
S: 0.003 to 0.5%, and
Zr: 0.0003 to 0.01%;
the following steel components are controlled in the following ranges respectively, in mass,
Al: 0.01% or less,
total 0: 0.02% or less, and
total N: 0.02% or less;
the steel further contains, in mass, one or more of Cr: 0.01 to 2.0%,
Ni: 0.05 to 2.0%, and
Mo: 0.05 to 1.0%;
the average aspect ratio of MnS grains is 10 or less and the maximum aspect ratio of those is 30 or less; and
the balance of the steel components consists of Fe and unavoidable impurities.

(4) A steel excellent in forgeability and machinability, characterized in that:
the steel contains, in mass,
C: 0.1 to 0.85%,
Si: 0.01 to 1.5%,
Mn: 0.05 to 2.0%,
P: 0.003 to 0.2%,
S: 0.003 to 0.5%, and
Zr: 0.0003 to 0.01%;
the following steel components are controlled in the following ranges respectively, in mass,
Al: 0.01% or less,
total 0: 0.02% or less, and
total N: 0.02% or less;
the steel further contains, in mass, one or more of
Cr: 0.01 to 2.0%,
Ni: 0.05 to 2.0%, and
Mo: 0.05 to 1.0%;
the average aspect ratio of MnS grains is 10 or less and the maximum aspect ratio of those is 30 or less;
further, the maximum grain size ($\mu$m) of MnS is equal to or less than 110×[S%]+15 and the number of the MnS grains per $mm^2$ is equal to or more than 3,800×[S%]+150; and
the balance of the steel components consists of Fe and unavoidable impurities.

(5) A steel excellent in forgeability and machinability, characterized in that the steel according to any one of the items (1) to (4) contains, in mass, at least one or more of
V: 0.05 to 1.0%,
Nb: 0.005 to 0.2%, and
Ti: 0.005 to 0.1%,
with the balance consisting of Fe and unavoidable impurities.

(6) A steel excellent in forgeability and machinability, characterized in that the steel according to any one of the items (1) to (5) contains, in mass, one or more of
Ca: 0.0002 to 0.005%,
Mg: 0.0003 to 0.005%, and
Te: 0.0003 to 0.005%,
with the balance consisting of Fe and unavoidable impurities.

(7) A steel excellent in forgeability and machinability, characterized in that the steel according to any one of the items (1) to (6) contains, in mass, one or both of
Bi: 0.05 to 0.5% and
Pb: 0.01 to 0.5%,
with the balance consisting of Fe and unavoidable impurities.

(8) A steel excellent in forgeability and machinability, characterized in that the steel according to any one of the items (1) to (7) contains, in mass, B by 0.0005% or more to less than 0.004%, with the balance consisting of Fe and unavoidable impurities.

BEST MODE FOR CARRYING OUT THE INVENTION

Figure 1A:
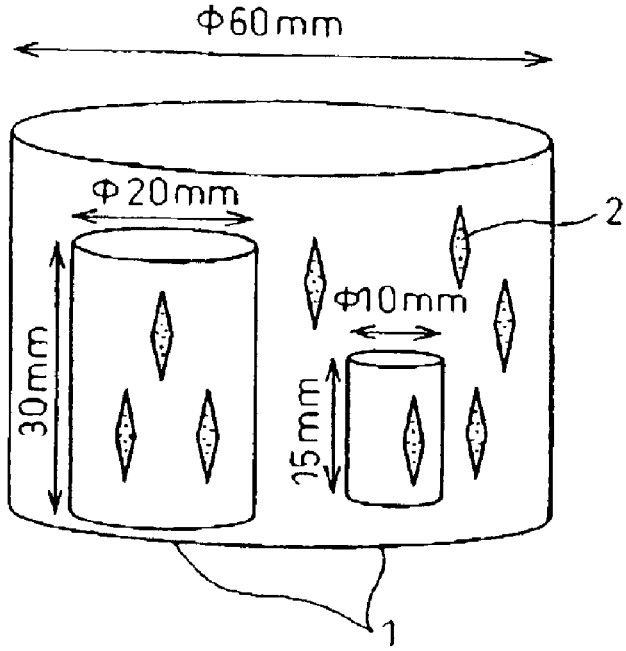
FIGS. 1(*a*) to 1(*c*) are illustrations for explaining the positions from which the test pieces for evaluating forging workability (in hot and cold) are cut out and the shape of the test pieces.

In the first place, the chemical composition of a steel according to the present invention is explained.

C is an element having a strong influence on the fundamental strength of a steel material and, for obtaining sufficient strength, the range of its content is set from 0.1 to 0.85%. When its content is below 0.1%, a sufficient strength is not obtained and, as a consequence, other alloying elements have to be added more abundantly. When the content of C exceeds 0.85%, C exists in a nearly hypereutectoid state and hard carbides precipitate in a great quantity, causing remarkable deterioration of machinability.

Si is added as a deoxidizing element and it is added for strengthening ferrite and securing temper softening resistance. In the present invention, it is indispensable as a deoxidizing element too. When its content is below 0.01%, no tangible effects are obtained and, when the content exceeds 1.5%, the steel is embrittled and deformation resistance at a high temperature is increased. For this reason, the upper limit of its content is set at 1.5%.

Mn is required for fixing and dispersing sulfur in a steel in the form of MnS. Also Mn is required for improving hardenability and securing strength after quenching by having it dissolve in the matrix of a steel. The lower limit of its content is set at 0.05%, because, when the content of Mn is below 0.05%, S forms FeS and the steel is embrittled. When the amount of Mn is large, the hardness of the base metal increases leading to the deterioration of cold workability and, besides, its effects on strength and hardenability are saturated. For this reason, the upper limit of Mn is set at 2.0%.

When the content of P in a steel increases, the hardness of the base metal increases and not only cold workability, but also hot workability and casting properties, are deteriorated. For this reason, its upper limit has to be set at 0.2%. On the other hand, P is an element effective for improving machinability and, for this reason, the lower limit is set at 0.003%.

S combines with Mn and exists in a steel in the form of MnS inclusions. While MnS improves machinability, when the grains of MnS are stretched, they act as one of the causes of the anisotropy of mechanical properties at forging, and, for this reason, its content must be controlled in consideration of the degree of the anisotropy and the required level of machinability. Since, on the other hand, S is likely to cause cracks during hot and cold forging, the upper limit of its content is set at 0.5%. Its lower limit is set at 0.003%, because this is the limit of not causing significant increase in production costs by the industrially applicable current technologies.

Zr is a deoxidizing element and it forms $ZrO_2$ or oxides containing Zr (hereinafter collectively referred to as Zr oxides). The oxides are considered to be $ZrO_2$ and, as they work as the nuclei of the precipitation of MnS, they increase the sites of the MnS precipitation and thus disperse MnS grains evenly. Also Zr dissolves in MnS to form composite sulfides and, by so doing, decreases the deformability of MnS grains and suppresses the stretching of MnS grains even in rolling or hot forging. Zr is, therefore, an effective element for decreasing the anisotropy. When its content is below 0.0003%, no tangible effect appears, but, when added at 0.01% or more, its yield is remarkably deteriorated and, what is more, hard $ZrO_2$, ZrS and so on are formed in great amounts and, rather, mechanical properties such as machinability, impact values and fatigue properties are deteriorated. For these reasons, Zr content is specified to be in the range from 0.0003 to 0.01%.

It has been known that MnS grains can be made spherical by an addition of Zr; there is a paper in Tetsu-to-Hagane, Vol. 62, No. 7, p.893 (1976), stating that, when eutectic inclusions of MnS-$Zr_3S_4$ are formed, the deformability of MnS is lowered and the stretching of MnS grains is suppressed, and that, for obtaining the effects, Zr at 0.02% or more is required for an S content of 0.07%. According to the above and other similar findings, it is important to form the composite sulfides for suppressing the deformability of MnS and, to this end, an addition of Zr in a great amount is required. However, an excessive addition of Zr leads to the formation of hard non-oxide inclusions such as the nitrides and sulfides of Zr and the clusters of these inclusions, causing the deterioration of mechanical properties and machinability. This means that the decrease in the deformability of MnS by the addition of Zr in a large amount inevitably leads to the adverse effects of the hard inclusions and their clusters.

In the present invention, in contrast, attention is paid to the role of Zr oxides as the nuclei of MnS precipitation rather than their effect of suppressing the deformability of MnS. The present inventors have studied a free-cutting steel considering that, even when MnS grains are stretched by rolling or forging, it does not constitute a crucial shortcoming for a steel material as long as MnS grains are dispersed finely in the steel. As a result of the studies, the present inventors have found that the Zr oxides formed through an addition of Zr by 0.01% or less can be dispersed in fine grains in a steel and, in addition, that the Zr oxides are likely to act as the nuclei of MnS precipitation. Actively utilizing the findings, the present inventors have developed a steel excellent in mechanical properties and machinability in which MnS is dispersed in fine grains.

By the present invention, Zr exists in a steel as simple oxides or composite oxides with other elements, and the oxides are dispersed finely and are likely to act as the nuclei of MnS precipitation in the steel. Then, as long as Zr oxides are dispersed finely solely as the nuclei of MnS precipitation, it is not necessary to add Zr excessively in relation to S content. Therefore, hard non-oxide inclusions such as the nitrides and sulfides of Zr and the clusters of these inclusions caused by an excessive addition of Zr are not generated and, as a consequence, the adverse effects resulting from the addition of Zr in a great amount, namely the deterioration of mechanical properties such as impact values and machinability, are avoided.

Al is a deoxidizing element and it forms $Al_2O_3$ in a steel. Since $Al_2O_3$ is hard, it causes damage to a cutting tool during machining work and accelerates its wear. Further, when Al is added, the amount of O is decreased and Zr oxides are hardly generated. Besides, in order to have $ZrO_2$ evenly dispersed in fine grains too, it is better not to add Al. The addition of Al has significant influences on the addition amount and yield of Zr and the distribution and shape of MnS grains. In view of this, the addition amount of Al is limited to 0.01% or less in the present invention in order to suppress the formation of hard $Al_2O_3$ and have the Zr oxides evenly dispersed in fine grains. By this, it is possible to significantly decrease the addition amount of Zr and increase the effect of the Zr addition on forming Zr oxides acting as the nuclei of MnS precipitation and the combined effect with MnS.

When O exists in the form of free oxygen, it forms bubbles during the cooling of a steel and causes pinholes. When it combines with Si, Al, Zr and so on, hard oxides are formed and, for this reason, it is necessary to control the amount of 0. In a steel according to the present invention, the upper limit of the content of 0 is set at 0.02%, the amount beyond which the effect of finely dispersing Zr oxides is lost.

N hardens a steel when it exists in the steel in the state of solid solution. In machining work, in particular, N hardens a steel near a cutting edge through dynamic strain aging, making the service life of a cutting tool short. Also, when N exists in the form of nitrides with Ti, Al, V and so on, it suppresses the growth of austenitic grains and, therefore, it is necessary to control the content of N. At a high temperature, in particular, it forms TiN, ZrN and the like. Even when nitrides are not formed, N causes bubbles to form during casting, leading to cracks and other defects. In the present invention, the upper limit of the content of N is set at 0.02%, the amount beyond which the adverse effects of N become conspicuous.

Cr is an element to enhance hardenability and render temper softening resistance to a steel. For this reason, Cr is added to a steel when high strength is required. To obtain tangible effects, it is necessary to add Cr at 0.01% or more. However, when it is added in a great amount, Cr carbides form and embrittle a steel, and, for this reason, the upper limit of its content is set at 2.0%.

Ni strengthens ferrite and enhances ductility. It is also effective for enhancing hardenability and corrosion resistance. When its addition amount is below 0.05%, no tangible effect is obtained, but, when added in excess of 2.0%, the effect to enhance the mechanical properties is saturated. For this reason, the upper limit of its content is set at 2.0%.

Mo is an element to render temper softening resistance to a steel and enhance hardenability. When its addition amount is below 0.05%, no tangible effect is obtained, but, when added in excess of 1.0%, the effect is saturated. For this reason, its addition amount is set in the range from 0.05 to 1.0%.

B is effective for strengthening grain boundaries and enhancing hardenability when it is in the state of solid solution. When it precipitates, it precipitates in the form of BN and it is effective for improving machinability. These effects do not become tangible when the addition amount of B is below 0.0005% but, when added at 0.004% or more, the effects are saturated and, if an excessive amount of BN precipitates, the mechanical properties of a steel are adversely affected. For this reason, its addition amount is set in the range from 0.0005% to below 0.004%.

V forms carbonitrides and strengthens a steel by secondary precipitation hardening. When its content is 0.05% or less, no strengthening effect appears and, when it is added in excess of 1.0%, carbonitrides precipitate in a great amount, deteriorating mechanical properties. Therefore, 1.0% is defined as the upper limit of its content. Note that it is desirable to add V at over 0.2%.

Elements such as V, Nb and Ti form nitrides, carbides, carbonitrides and so on in a steel. As the grains of these compounds suppress the growth of austenitic grains by acting as pinning grains, these elements are often used for controlling austenitic grain size when a steel is heated to a temperature equal to or above its transformation temperature in forging or heat treatment. Their precipitation temperatures are different from each other, but, considering the accuracy of the temperature control in an industrially adopted heat treatment, it is necessary to obtain the pinning effect in the widest possible temperature range and thus control the austenitic grain size. In hot forging, in particular, the temperature at each position of a work piece varies greatly during cooling depending on the shape of the work piece.

Whereas Nb and Ti form precipitates at a comparatively high temperature, V forms the precipitates of carbides at a lower temperature than Nb or Ti does and, for this reason, it is preferable to add V. When V is added alone, the above effect can be obtained by controlling the addition amount to over 0.2% to 1.0%. Further, by using Nb and/or Ti in combination with V, the precipitates having the most suitable grain size as pinning grains can be dispersed evenly in a steel.

When a plurality of the above elements are added in combination, the austenitic grain size can be controlled even if the addition amount of V is smaller than in the case of the single addition of V, and the above effect can be obtained even when the least addition amount of V is 0.05%.

For this reason, the lower limit of the addition amount of V is set at 0.05 when Nb and/or Ti is/are added together with V.

Nb also forms carbonitrides and strengthens a steel through secondary precipitation hardening. When added by 0.005% or less, it is not effective for strengthening a steel, and, when added in excess of 0.2%, carbonitrides precipitate in a great amount and rather deteriorate mechanical properties. Therefore, the upper limit of Nb is set at 0.2%.

Ti also forms carbonitrides and strengthens a steel. Ti is also a deoxidizing element and, by forming soft oxides, it improves machinability. When the addition amount is 0.005% or less, no tangible effect is obtained and, when it is added in excess of 0.1%, the effect is saturated. Besides, Ti forms nitrides even at a high temperature and thus suppresses the growth of austenitic grains. In consideration of the above, the upper limit of Ti is set at 0.1%.

Ca is a deoxidizing element and, by forming soft oxides, it improves machinability. Besides, Ca dissolves in MnS, lowers the deformability of MnS grains, and thus has a function of suppressing the stretching of MnS grains even in rolling or hot forging. Therefore, Ca is an effective element for decreasing the anisotropy of mechanical properties. When its addition amount is below 0.0002%, its effect is not significant, and, when the addition amount exceeds 0.005%, not only is the yield significantly lowered but also hard CaO is formed in a great amount and machinability is rather deteriorated. For these reasons, the range of the Ca content is specified to be 0.0002 to 0.005%.

Mg is a deoxidizing element and forms oxides. The oxides act as the nuclei of MnS precipitation, and have an effect of evenly dispersing MnS in fine grains. Thus, it is an effective element for decreasing the anisotropy. When its addition amount is below 0.0003%, its effect is not significant, and, when the addition amount exceeds 0.005%, the effect is saturated and the yield is drastically lowered. For these reasons, the range of the Mg content is specified to be 0.0003 to 0.005%.

Te is an element to improve machinability. Further, Te has the function of lowering the deformability of MnS grains and suppressing the stretching of MnS grains by forming MnTe or coexisting with MnS. Therefore, it is an effective element for reducing the anisotropy. When its addition amount is below 0.0003%, no tangible effect shows up, and, when the addition amount exceeds 0.005%, it is likely to cause cracks during casting.

Bi and Pb are elements effective in improving machinability. The effect is not tangible when the addition amount of each of them is below 0.05%, and, when the addition amount exceeds 0.5%, not only the machinability improvement effect is saturated but also hot casting properties are deteriorated and cracks are likely to occur.

Next, in the present invention, in addition to the chemical composition explained above, the average aspect ratio and the maximum aspect ratio of MnS grains, the maximum size of MnS grains, the number of MnS grains per unit sectional area (1 $mm^2$) are important factors. It is necessary to control the average aspect ratio of MnS grains to 10 or less, the maximum aspect ratio thereof to 30 or less, the maximum grain size ($\mu$m) thereof to equal to or less than 110×[S %]+15 and the number thereof per $mm^2$ to equal to or more than 3,800×[S %]+150.

Figure 8A:
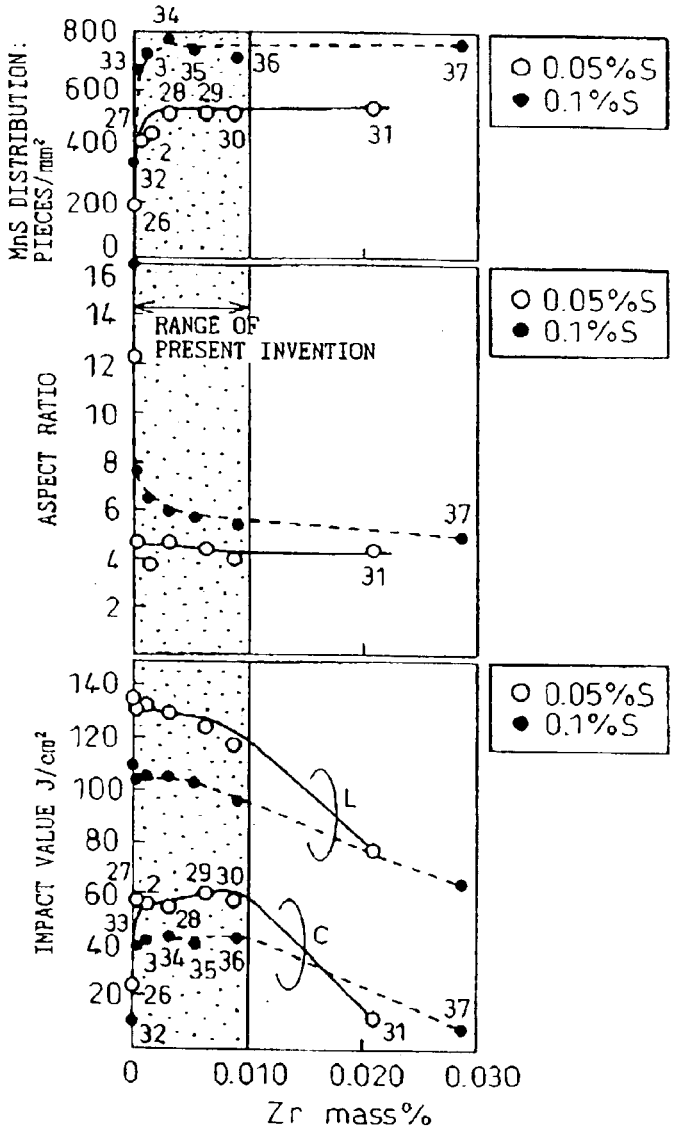
FIG. 8(*a*) is a graph showing the influences of Zr content on the impact value at an impact test, the shape of sulfides and the number thereof, and FIG. 8(*b*) an illustration showing the position from which test pieces are cut out.
Figure 8B:
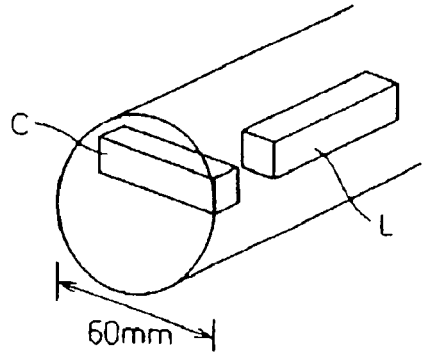

The reasons why the average aspect ratio of MnS grains must be 10 or less and the maximum aspect ratio thereof 30 or less are as follows. As shown in FIGS. 8(*a*) and 9, the aspect ratio tends to be larger as the initial grain size of MnS becomes large. As explained later in the example, when the aspect ratio is large, the anisotropy of material properties is increased and the impact value in the sectional direction is lowered, deteriorating fatigue strength. As a work piece is subjected to widely varied deformation during forging, MnS grains stretched by the deformation often act as the points of initiating fracture. In such a situation, if the average aspect ratio of MnS grains is 20 or more, the deterioration of fracture property caused by the stretched MnS grains becomes conspicuous. Further, with regard to the maximum aspect ratio of the MnS grains, when it exceeds 30, the deterioration of the fracture property caused by the stretched MnS grains becomes conspicuous.

The reasons why the maximum grain size ($\mu$m) of MnS is equal to or less than 110×[S %]+15 and the number of the MnS grains per $mm^2$ is equal to or more than 3,800×[S %]+150 are as follows. MnS grains are known to be likely to act as the points of initiating fracture because they become the sites of stress concentration, and, in particular, the size has a strong influence on the phenomenon. On the other hand, the present inventors discovered that, while machinability was improved in proportion to the content of S, the influence of the size of MnS grains on machinability was not so significant as on fracture. For this reason, among the steels having the same content of S, a steel having a large number of small MnS grains dispersed in it is superior in fracture property and forgeability to a steel having a smaller number of large MnS grains dispersed in it though their machinability is the same. The present inventors also discovered that, though the above effect was influenced by the content of S, machinability proportional to the addition amount of S could be secured while the deterioration of forgeability and fracture property could be minimized, as far as the maximum grain size ($\mu$m) of MnS was controlled to equal to or less than 110×[S %]+15 and the number of the MnS grains per $mm^2$ to equal to or more than 3,800×[S%]+150, as shown in FIGS. 8(*a*) and 9. In contrast, when the maximum grain size ($\mu$m) of MnS exceeds 110×[S %]+15, or the number of the MnS grains per $mm^2$ exceeds 3,800×[S %]+150, the fracture property and forgeability are poor.

MnS inclusions are examined using an image processor and the following items are calculated regarding each MnS grain: circle-equivalent diameter (R), length in the rolling direction (L), thickness in the radius direction (H), and aspect ratio (L/H). An image processor digitizes an optically obtained image using a CCD camera and, with it, the size of an MnS grain, the area occupied by MnS grains and so on can be measured. Fifty observation fields, each observation field being 9,000 $\mu m^2$, are measured repeatedly under the magnification of 500 times. With the image processor, it is possible to calculate the maximum and average values of all the above measured items regarding MnS grains. Here, the average aspect ratio is the average value of the aspect ratios of all the MnS grains, and the maximum aspect ratio is the largest value among all the measured aspect ratios.

The size of a MnS grain is the diameter calculated by converting the area of the MnS grain measured with the image processor into a circle, that is, the so-called circle-equivalent diameter, and the number of MnS grains per $mm^2$ is the quotient of the number of MnS grains in a measured area divided by the area ($mm^2$) of the measurement.

EXAMPLES

The effects of the present invention are explained hereafter based on examples. The examples listed in Table 1 were prepared by melting steels in a 2-t vacuum melting furnace, rolling them into billets and then rolling them further into bars 60 mm in diameter. Hot upsetting test pieces for evaluating hot workability and cold upsetting test pieces for evaluating cold workability were cut out after the rolling and they were subjected to upsetting test. Some of the rolled steel materials were heated to 1,200° C. for heat treatment and then left to cool in normal atmosphere and then subjected to machining test.

In the present invention, the content of Zr in a steel was analyzed as follows: samples were treated in the same manner as the method specified in Annex 3 of Japanese Industrial Standard (JIS) G 1237-1997, and then the content of Zr in a steel was measured by the ICP (inductive coupled plasma atomic emission spectrometry) in the same manner as the measurement of the content of Nb in a steel. The samples used for the measurement in the example of the present invention were 2 g per steel grade and the calibration curves for the ICP were set so as to suit for measuring very small amounts of Zr, that is, Zr solutions having different Zr concentrations were prepared by diluting a standard solution of Zr so that the Zr concentrations varied from 1 to 200 ppm, and the calibration curves were set through the measurement of the Zr concentrations of the diluted solutions. Here, the methods common to the ICP measurement were based on JIS K 0116-1995 (General Rules for Atomic Emission Spectrometry) and JIS Z 8002-1991 (General Rules regarding Tolerances in Analyses and Tests).

Figure 1B:
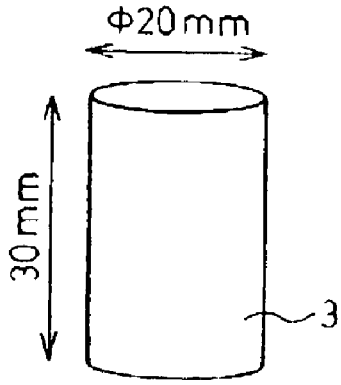
Figure 1C:
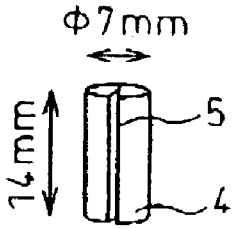

FIG. 1 comprises illustrations for explaining the positions from which the test pieces for evaluating forging workability (hot and cold) are cut out and the shape of the test pieces. A test piece 3 for a hot upsetting test shown in FIG. 1(*b*) and a test piece 4 for a cold upsetting test having a notch 5 shown in FIG. 1(*c*) were cut out from the positions 1 in FIG. 1(*a*) so that the long axes of MnS grains 2 in a steel were in the longitudinal direction of the test pieces.

Figure 2:
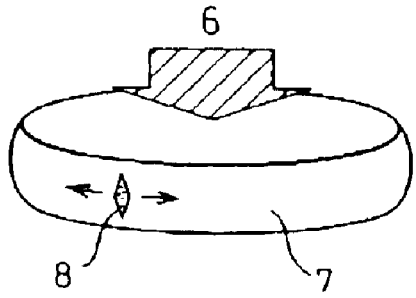
FIG. 2 is an illustration explaining the positions where cracks occur in an upsetting test.

FIG. 2 is an illustration explaining the positions where cracks occur in an upsetting test. In the upsetting test, when a test piece is deformed (7) under a load 6, a tensile stress is created around the periphery in the circumferential direction, as shown in FIG. 2. In this case, it is often the case that MnS grains in a steel act as the points of initiating fracture and thus cracks 8 develop. The workability in forging work can be evaluated by the upsetting test of the test pieces cut out as explained above.

Figure 3:
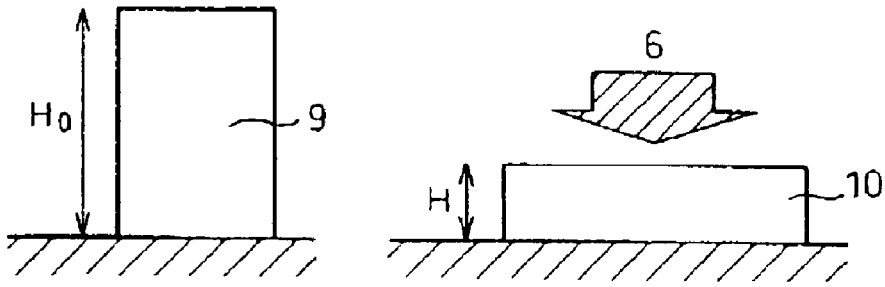
FIG. 3 is an illustration explaining the definition of strain at the evaluation of forging workability (upsetting test).

A test piece for the hot upsetting test having the diameter of 20 mm and the length of 30 mm and a thermocouple embedded therein was heated to 1,000° C. by high frequency heating and subjected to upsetting forging work within 3 sec. after the heating. The test pieces were forged under different strains, and the strain which developed cracks when the test pieces were forged from the shape 9, before deformation to the shape 10, after deformation as shown in FIG. 3 was measured as the critical strain. Here, a strain is the so-called nominal strain defined by the following equation (1):

$$\epsilon=(H_o-H)/H_o \quad (1),$$

where, $\epsilon$ is a strain, $H_o$ is the height of a test piece before deformation, and H is the height of the test piece after deformation.

Table 1 shows the examples used for the evaluation of workability. The invented examples 1 to 5 in Table 1 are made of S45C based steels containing different amounts of S. The comparative examples 6 to 10 are made of steels without the addition of Zr. The comparative examples 11 and 12 are made of steels containing a great amount of Al, without an addition of Zr but with an addition of Pb. The comparative examples 13 and 14 are made of steels containing Zr, a great amount of Al, and different amounts of S. In the comparative example 15, a great amount of Al is added but Zr is not. Comparing the examples having the same level of S content, the comparative examples 11 and 12 containing Pb are inferior in hot forgeability. Among the examples having higher contents of S, the invented examples 2 to 5 to which Zr is added are superior to the comparative examples 7 to 10. Further, as seen with the comparative examples 14 and 15, when the content of S is high and the content of Al is also high, hot formability is poor compared with the invented examples, regardless of whether Zr is added or not.

TABLE 1

| Sample | | Chemical composition | | | | | | | | | |
|---|---|---|---|---|---|---|---|---|---|---|---|
| No. | Classification | C | Si | Mn | P | S | Zr | Al | total D | total N | Pb |
| 1. | Invented example | 0.44 | 0.26 | 0.41 | 0.020 | 0.022 | 0.0015 | 0.009 | 0.0025 | 0.0035 | — |
| 2. | Invented example | 0.43 | 0.27 | 0.44 | 0.021 | 0.052 | 0.0018 | 0.002 | 0.0024 | 0.0046 | — |

TABLE 1-continued

| | | | | | | | | | | | |
|---|---|---|---|---|---|---|---|---|---|---|---|
| 3. | Invented example | 0.47 | 0.27 | 0.43 | 0.023 | 0.093 | 0.0019 | 0.004 | 0.0022 | 0.0055 | — |
| 4. | Invented example | 0.45 | 0.28 | 0.42 | 0.023 | 0.141 | 0.0091 | 0.003 | 0.0027 | 0.0046 | — |
| 5. | Invented example | 0.49 | 0.29 | 0.42 | 0.024 | 0.193 | 0.0016 | 0.008 | 0.0026 | 0.0049 | — |
| 6. | Comparative example | 0.43 | 0.22 | 0.44 | 0.021 | 0.024 | <0.0002 | 0.003 | 0.0023 | 0.0048 | — |
| 7. | Comparative example | 0.45 | 0.23 | 0.45 | 0.019 | 0.050 | <0.0002 | 0.004 | 0.0028 | 0.0052 | — |
| 8. | Comparative example | 0.46 | 0.27 | 0.43 | 0.021 | 0.101 | <0.0002 | 0.002 | 0.0026 | 0.0046 | — |
| 9. | Comparative example | 0.47 | 0.26 | 0.46 | 0.024 | 0.137 | <0.0002 | 0.003 | 0.0031 | 0.0056 | — |
| 10. | Comparative example | 0.44 | 0.23 | 0.43 | 0.023 | 0.197 | <0.0002 | 0.002 | 0.0026 | 0.0058 | — |
| 11. | Comparative example | 0.45 | 0.27 | 0.44 | 0.022 | 0.023 | <0.0002 | 0.008 | 0.0029 | 0.0047 | 0.08 |
| 12. | Comparative example | 0.44 | 0.26 | 0.43 | 0.021 | 0.023 | <0.0002 | 0.008 | 0.0025 | 0.0048 | 0.18 |
| 13. | Comparative example | 0.47 | 0.23 | 0.48 | 0.024 | 0.025 | <0.0002 | 0.021 | 0.0016 | 0.0056 | — |
| 14. | Comparative example | 0.48 | 0.25 | 0.42 | 0.027 | 0.092 | <0.0002 | 0.018 | 0.0019 | 0.0040 | — |
| 15. | Comparative example | 0.46 | 0.26 | 0.41 | 0.019 | 0.088 | 0.0072 | 0.024 | 0.0016 | 0.0039 | — |

| Sample No. | Classification | Average aspect ratio | Maximum aspect ratio | Maximum MnS grain size | Number of MnS grains | Hot critical strain % | Hardness after natural cooling HV | Hardness after annealing HV | Cold critical strain % | VL 1000 m/min |
|---|---|---|---|---|---|---|---|---|---|---|
| 1. | Invented example | 2.6 | 12.5 | 13.4 | 321 | 94 | 221 | 162 | 48 | 14 |
| 2. | Invented example | 3.8 | 17.3 | 18.4 | 420 | 92 | 224 | 164 | 42 | 21 |
| 3. | Invented example | 6.5 | 19.6 | 18.6 | 736 | 86 | 231 | 161 | 41 | 24 |
| 4. | Invented example | 7.0 | 16.7 | 23.1 | 1453 | 78 | 215 | 158 | 37 | 35 |
| 5. | Invented example | 6.8 | 22.5 | 25.8 | 1642 | 71 | 228 | 160 | 35 | 45 |
| 6. | Comparative example | 3.6 | 32.6 | 19.3 | 186 | 90 | 221 | 162 | 40 | 14 |
| 7. | Comparative example | 4.2 | 35.4 | 25.4 | 211 | 85 | 210 | 159 | 38 | 20 |
| 8. | Comparative example | 8.7 | 34.1 | 29.3 | 365 | 73 | 208 | 155 | 33 | 23 |
| 9. | Comparative example | 9.5 | 40.6 | 32.4 | 421 | 62 | 231 | 152 | 29 | 32 |
| 10. | Comparative example | 10.6 | 52.3 | 32.1 | 445 | 50 | 229 | 162 | 28 | 44 |
| 11. | Comparative example | 3.2 | 30.5 | 19.6 | 210 | 86 | 210 | 159 | 39 | 20 |
| 12. | Comparative example | 3.7 | 31.6 | 22.6 | 169 | 82 | 222 | 160 | 37 | 25 |
| 13. | Comparative example | 4.1 | 32.1 | 56.3 | 236 | 93 | 205 | 162 | 42 | 9 |
| 14. | Comparative example | 8.6 | 41.9 | 28.5 | 359 | 79 | 220 | 159 | 35 | 12 |
| 15. | Comparative example | 11.2 | 42.1 | 25.6 | 346 | 75 | 221 | 163 | 28 | 11 |

Figure 4:
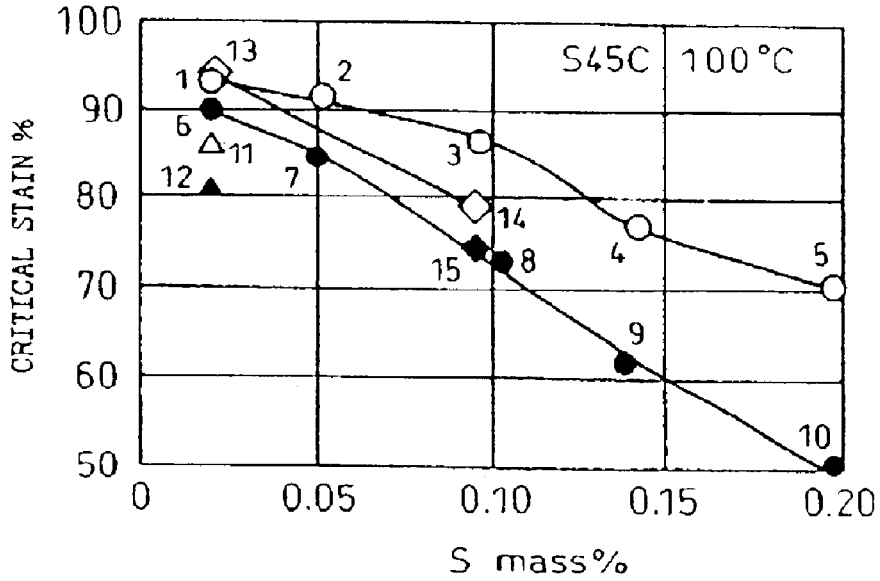
FIG. 4 is a graph showing the influence of S content on the hot forgeability of the examples listed in Table 1.

FIG. 4 is a graph showing the influence of S content on the hot forgeability of the examples listed in Table 1.

Figure 5:
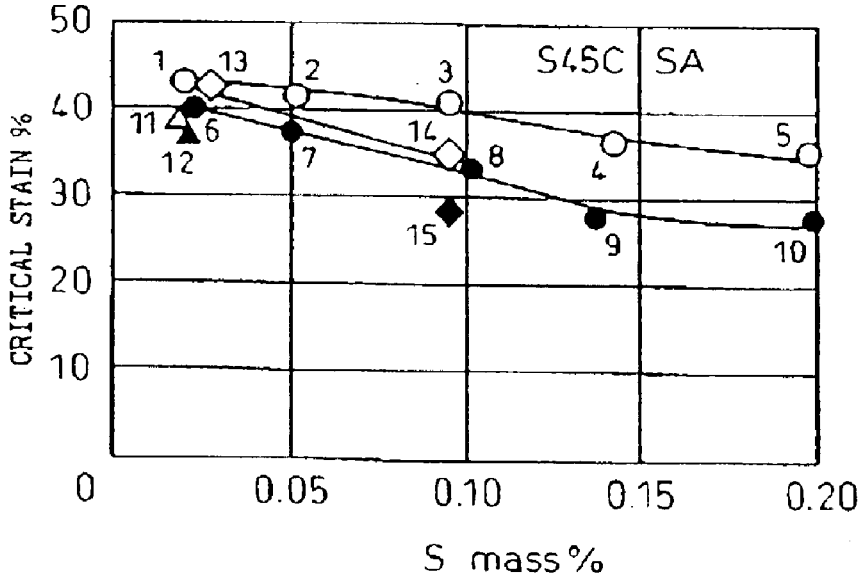
FIG. 5 is a graph showing the influence of S content on the cold forgeability of the examples listed in Table 1.

A cold upsetting test was carried out for evaluating cold workability. Materials cut out as shown in FIG. 1 were quenched at 850° C., then annealed for spheroidizing at 700° C. for 12 h., and then cold upsetting test pieces 7 mm in diameter and 14 mm in length with a 2-mm notch were prepared by machining work. FIG. 5 shows the result of measuring the critical strains of the examples 1 to 15 at the cold working. The definition of a strain is the same as that defined by the equation (1).

Figure 6:
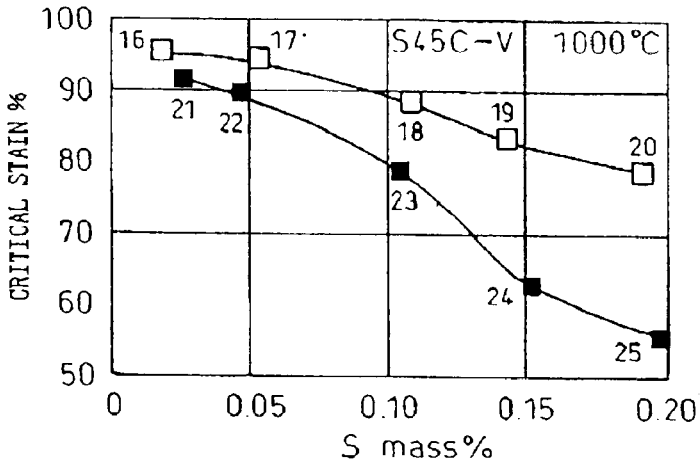
FIG. 6 is a graph showing the influence of S content on the hot workability of the examples listed in Table 2.

Likewise, Table 2 shows the examples in which V is added to S45C for making austenitic grains fine and improving strength. FIG. 6 shows the result of evaluating the hot forgeability of the examples shown in Table 2 at 1,000° C. Here, the hot forgeability deteriorates as the amount of S increases, and, when the examples having the same content of S are compared, the invented examples 17 to 20 demonstrate better hot forgeability than the comparative examples 22 to 25.

TABLE 2

| Sample No. | Classification | Chemical composition C | Si | Mn | P | S | Zr | Al | total D | total N | V |
|---|---|---|---|---|---|---|---|---|---|---|---|
| 16. | Invented example | 0.43 | 0.26 | 0.47 | 0.020 | 0.024 | 0.0011 | 0.007 | 0.0025 | 0.0056 | 0.22 |
| 17. | Invented example | 0.42 | 0.27 | 0.45 | 0.021 | 0.052 | 0.0016 | 0.009 | 0.0029 | 0.0040 | 0.21 |
| 18. | Invented example | 0.47 | 0.27 | 0.46 | 0.024 | 0.109 | 0.0099 | 0.006 | 0.0021 | 0.0055 | 0.22 |
| 19. | Invented example | 0.45 | 0.28 | 0.42 | 0.027 | 0.142 | 0.0020 | 0.009 | 0.0030 | 0.0036 | 0.28 |
| 20. | Invented example | 0.48 | 0.29 | 0.42 | 0.024 | 0.190 | 0.0056 | 0.002 | 0.0026 | 0.0049 | 0.22 |
| 21. | Comparative example | 0.43 | 0.22 | 0.46 | 0.021 | 0.026 | <0.0002 | 0.004 | 0.0022 | 0.0048 | 0.20 |
| 22. | Comparative example | 0.47 | 0.23 | 0.43 | 0.021 | 0.049 | <0.0002 | 0.003 | 0.0026 | 0.0042 | 0.24 |
| 23. | Comparative example | 0.45 | 0.27 | 0.47 | 0.024 | 0.105 | <0.0002 | 0.002 | 0.0031 | 0.0046 | 0.26 |
| 24. | Comparative example | 0.44 | 0.26 | 0.42 | 0.019 | 0.152 | <0.0002 | 0.005 | 0.0033 | 0.0051 | 0.22 |
| 25. | Comparative example | 0.43 | 0.23 | 0.42 | 0.023 | 0.198 | <0.0002 | 0.003 | 0.0027 | 0.0043 | 0.24 |

| Sample No. | Classification | Average aspect ratio | Maximum aspect ratio | Maximum MnS grain size | Number of MnS grains | Hot critical strain % | Hardness after natural cooling HV | VL 1000 m/min |
|---|---|---|---|---|---|---|---|---|
| 16. | Invented example | 2.8 | 11.3 | 15.4 | 356 | 95 | 275 | 12 |
| 17. | Invented example | 4.6 | 15.2 | 17.4 | 564 | 94 | 270 | 15 |
| 18. | Invented example | 4.8 | 16.4 | 19.6 | 786 | 89 | 291 | 20 |
| 19. | Invented example | 5.6 | 20.4 | 21.5 | 1126 | 84 | 265 | 28 |
| 20. | Invented example | 5.5 | 23.1 | 23.4 | 1657 | 60 | 278 | 35 |
| 21. | Comparative example | 4.7 | 32.1 | 19.6 | 124 | 92 | 261 | 10 |
| 22. | Comparative example | 7.8 | 33.5 | 25.1 | 256 | 89 | 270 | 13 |
| 23. | Comparative example | 8.5 | 35.6 | 27.6 | 354 | 79 | 278 | 19 |
| 24. | Comparative example | 11.0 | 42.6 | 29.5 | 450 | 62 | 201 | 28 |
| 25. | Comparative example | 10.4 | 46.7 | 35.1 | 620 | 58 | 279 | 33 |

Figure 7:
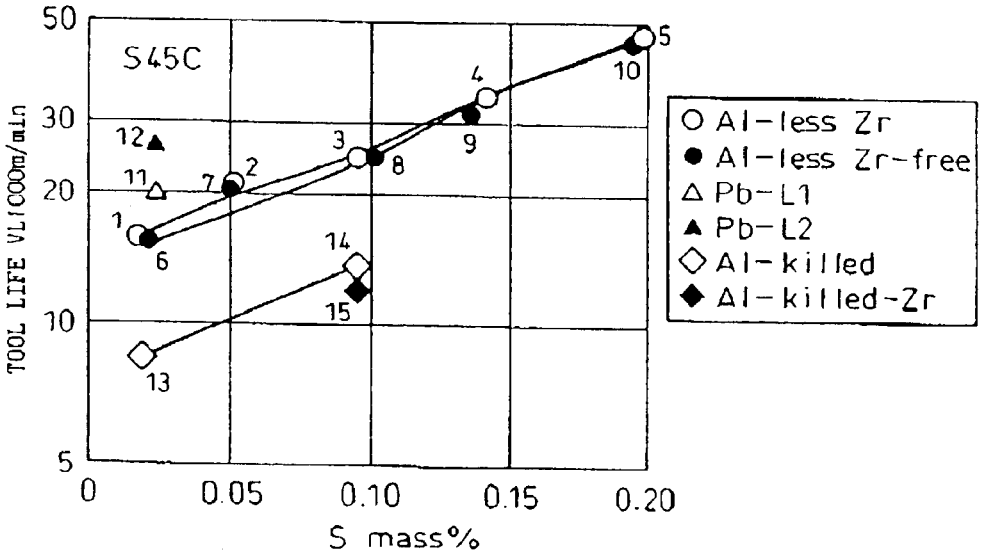
FIG. 7 is a graph showing the influence of S content on the machinability of the examples listed in Table 1.

FIG. 7 shows the result of evaluating the machinability of the examples listed in Table 1. Machinability was evaluated by applying drilling test under the conditions shown in Table 3 and by the maximum cutting speed at which a drilling tool could be used up to a cumulative drilling depth of 1,000 mm without changing the tool (the so-called VL1000).

TABLE 3

| Cutting condition | Drilling tool | Others |
|---|---|---|
| Cutting speed: 10 to 90 m/min. Feed rate: 0.25 mm/rev. Water soluble cutting liquid | ϕ3 mm Normal drill of NACHI Protrusion: 45 mm | Drilling depth: 9 mm Tool life: up to breakage |

As seen in FIG. 7, the larger the content of S is, the better the machinability is. Comparing the examples having the same content of S, however, the examples to which a great amount of Al is added (the examples 13 to is 15) are inferior in machinability to the examples in which the content of Al is controlled within the range of the present invention. When the content of Al is within the range of the present invention, comparing the examples with and without the addition of Zr, the examples containing the same amount of S show the same level of machinability regardless of whether Zr is added or not at any level of S content. Then, compared with the examples 11 and 12 to which Pb is added, the example 2 shows the same level of machinability as the example 11, but, in terms of hot workability, the example 2 is better than the example 11 as seen in FIG. 4. Likewise, in the comparison between the examples 3 and 12, the invented example 3 shows better hot workability than the example 12, although both show the same level of machinability. As demonstrated above, the present invention is effective for obtaining both good hot workability and good machinability.

A similar effect is seen in the examples to which V is added for enhancing strength: as seen in the numerical result of evaluating machinability shown in Table 2, the invented and comparative examples having the same amount of S show the same level of machinability. This shows that, by the present invention, both good forgeability and good machinability can be obtained even when steel strength is increased.

Table 4 shows the examples having different contents of Zr. The relation between mechanical properties and Zr content was examined on the examples listed in Table 4 and the examples 2 and 3. FIG. 8(*a*) shows the impact value, the aspect ratio of the sulfide grains and the number of the sulfide grains per unit area in relation to the Zr content. The test pieces for the impact test were cut out as shown in FIG. 8(*b*), wherein L indicates the case that a test piece was cut out longitudinally and C the case that a test piece was cut out in the sectional direction. When Zr is not added, while the impact value in the rolling direction is good, that in the sectional direction is very low. The larger the content of S is, the more conspicuous this tendency is. However, when Zr is added, although the impact value in the rolling direction is slightly lowered, that in the sectional direction is improved significantly. This is presumably because of the dispersion of fine sulfide grains and the improvement of the aspect ratio. In particular, when the number of sulfide grains is large and the grains are fine and well dispersed, even if sulfide grains having large aspect ratios are included, their adverse effects on mechanical properties are suppressed, presumably because of the small size of the sulfide grains.

TABLE 4

| Sample | | Chemical composition | | | | | | | | |
|---|---|---|---|---|---|---|---|---|---|---|
| No. | Classification | C | Si | Mn | P | S | Zr | Al | total D | total N |
| 26. | Comparative example | 0.45 | 0.23 | 0.45 | 0.019 | 0.050 | <0.0002 | 0.004 | 0.0028 | 0.0052 |
| 27. | Invented example | 0.43 | 0.24 | 0.46 | 0.018 | 0.054 | 0.0008 | 0.005 | 0.0027 | 0.0046 |
| 2. | Invented example | 0.43 | 0.27 | 0.44 | 0.021 | 0.052 | 0.0018 | 0.002 | 0.0024 | 0.0046 |
| 28. | Invented example | 0.43 | 0.27 | 0.45 | 0.023 | 0.052 | 0.0035 | 0.009 | 0.0031 | 0.0042 |
| 29. | Invented example | 0.46 | 0.25 | 0.47 | 0.024 | 0.049 | 0.0066 | 0.006 | 0.0029 | 0.0045 |
| 30. | Invented example | 0.45 | 0.28 | 0.43 | 0.021 | 0.042 | 0.0090 | 0.009 | 0.0022 | 0.0046 |
| 31. | Comparative example | 0.42 | 0.27 | 0.44 | 0.022 | 0.052 | 0.0205 | 0.002 | 0.0023 | 0.0038 |
| 32. | Comparative example | 0.46 | 0.27 | 0.43 | 0.021 | 0.101 | <0.0002 | 0.002 | 0.0026 | 0.0046 |
| 33. | Invented example | 0.45 | 0.23 | 0.44 | 0.029 | 0.106 | 0.0009 | 0.006 | 0.0012 | 0.0036 |
| 3. | Invented example | 0.47 | 0.27 | 0.43 | 0.023 | 0.093 | 0.0019 | 0.004 | 0.0022 | 0.0055 |
| 34. | Invented example | 0.44 | 0.28 | 0.43 | 0.022 | 0.096 | 0.0036 | 0.009 | 0.0031 | 0.0042 |
| 35. | Invented example | 0.45 | 0.24 | 0.45 | 0.021 | 0.119 | 0.0058 | 0.007 | 0.0019 | 0.0055 |
| 36. | Invented example | 0.45 | 0.24 | 0.45 | 0.024 | 0.099 | 0.0092 | 0.006 | 0.0023 | 0.0036 |
| 37. | Comparative example | 0.43 | 0.26 | 0.42 | 0.023 | 0.111 | 0.0288 | 0.002 | 0.0023 | 0.0038 |

| Sample No. | Classification | Average aspect ratio | Maximum aspect ratio | Maximum MnS grain size | Number of MnS grains | Hardness after natural cooling HV | Impact value J/cm³ Longitudinal direction | Impact value J/cm³ Sectional direction | VL 1000 m/min | Remarks |
|---|---|---|---|---|---|---|---|---|---|---|
| 26. | Comparative example | 12.4 | 32.6 | 24.6 | 195 | 210 | 134 | 26 | 20 | 0.05% S |
| 27. | Invented example | 4.2 | 14.5 | 17.9 | 405 | 221 | 132 | 58 | 21 | |
| 2. | Invented example | 3.8 | 17.3 | 16.4 | 420 | 224 | 121 | 57 | 21 | |
| 28. | Invented example | 4.4 | 16.8 | 15.2 | 506 | 224 | 118 | 60 | 22 | |
| 29. | Invented example | 4.3 | 11.4 | 16.5 | 510 | 231 | 116 | 60 | 22 | |
| 30. | Invented example | 3.9 | 15.0 | 18.6 | 495 | 219 | 108 | 59 | 21 | |
| 31. | Comparative example | 4.0 | 18.4 | 17.6 | 510 | 220 | 97 | 17 | 12 | |
| 32. | Comparative example | 16.0 | 42.6 | 27.5 | 321 | 208 | 110 | 9 | 24 | 0.10% S |

TABLE 4-continued

| | | | | | | | | | |
|---|---|---|---|---|---|---|---|---|---|
| 33. | Invented example | 7.8 | 18.2 | 19.4 | 685 | 222 | 102 | 40 | 25 |
| 3. | Invented example | 6.5 | 19.6 | 18.6 | 736 | 231 | 106 | 40 | 25 |
| 34. | Invented example | 5.9 | 13.8 | 21.4 | 795 | 241 | 104 | 42 | 26 |
| 35. | Invented example | 5.5 | 14.7 | 20.6 | 747 | 228 | 100 | 40 | 24 |
| 36. | Invented example | 5.0 | 15.5 | 23.2 | 682 | 229 | 97 | 42 | 25 |
| 37. | Comparative example | 5.0 | 16.4 | 22.1 | 774 | 232 | 61 | 9 | 16 |

Figure 9:
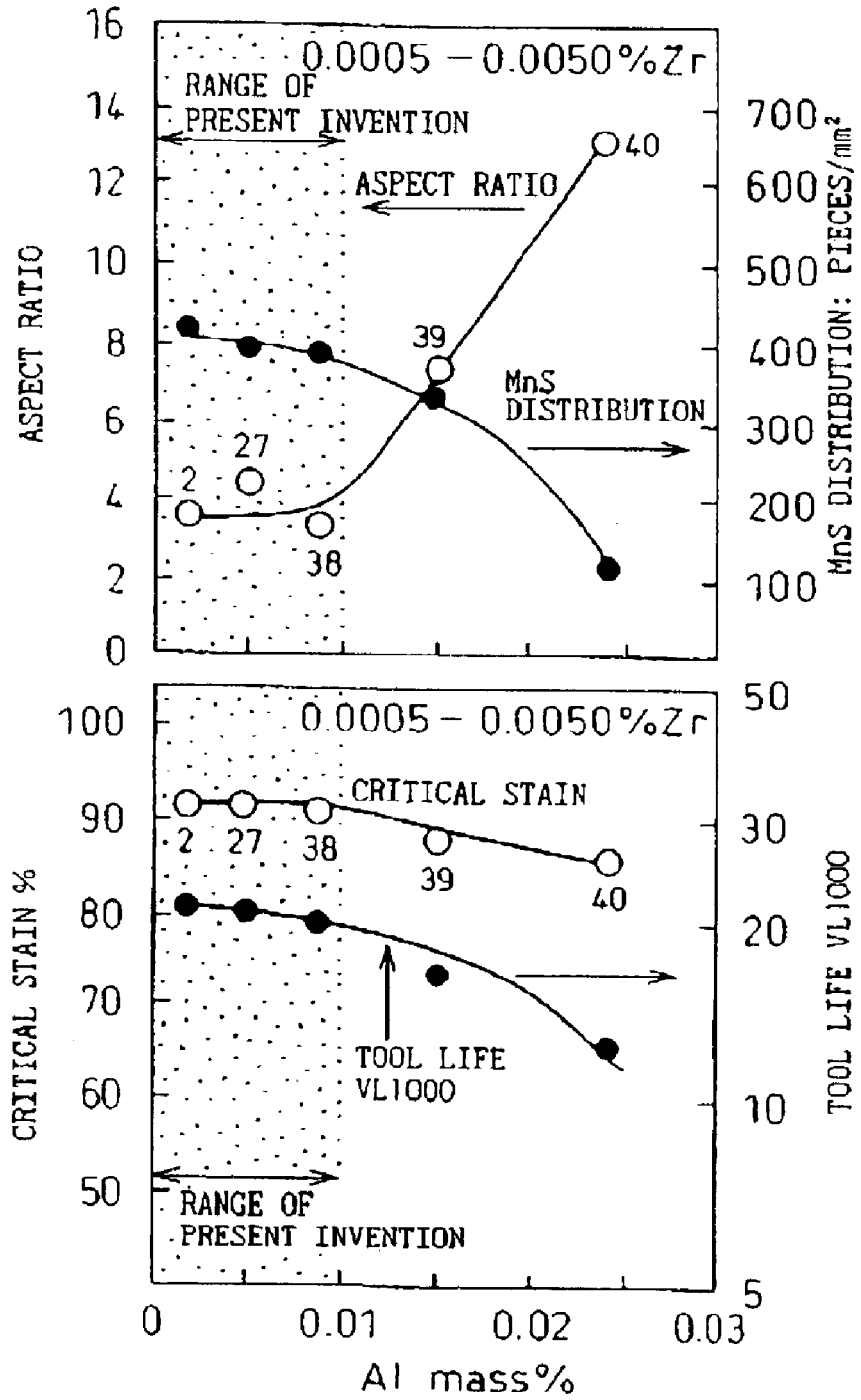
FIG. 9 is a graph showing the influences of Al addition amount on the shape and number of sulfides, hot forgeability and machinability.

Further, Table 5 shows the examples containing different amounts of Al. As stated before, machinability is lowered as the content of Al increases. In relation to this, for clarifying the effects of the content of Al, the influence of the Al amount on the shape of sulfide grains was examined using the examples in Table 5 and the examples 2 and 27, and the result is shown in FIG. 9. In the steels to which a very small amount of Zr is added, when the content of Al exceeds 0.01%, the number of sulfide grains decreases and, at the same time, their aspect ratio is increased, and, in addition, the critical strain in the hot upsetting test is decreased. Further, as the content of Al increases, the machinability in terms of AL1000 is significantly lowered. For this reason, the content of Al is specified to be 0.01% or less in the present invention.

ability of the examples are the same as those of the examples shown in Table 1. Tables 6, 6-1,6-2 and 6-3 show the hot critical strain and machinability of the examples 41 to 72, to which various alloying elements are added. The comparative examples in these tables are significantly inferior in hot critical strain to the invented examples, although not very much so in machinability. As seen with the examples 73 to 78 in these tables, the invented examples are superior to the comparative examples, even when the fundamental strength of the steels is changed through the control of the C content. The examples 79 and 80 in Tables 6-1 and 6-3 are the comparative examples wherein the amounts of total O and total N are outside the ranges of the present invention, respectively, and they are inferior to the invented example 2 in both hot critical strain and machinability. As explained above, the examples within the ranges of the present invention are superior to the comparative examples having the same content of S in both hot workability and machinability.

TABLE 5

| Sample | | Chemical composition | | | | | | | | |
|---|---|---|---|---|---|---|---|---|---|---|
| No. | Classification | C | Si | Mn | P | S | Zr | Al | total D | total N |
| 2. | Invented example | 0.43 | 0.27 | 0.44 | 0.023 | 0.052 | 0.0018 | 0.002 | 0.0024 | 0.0046 |
| 27. | Invented example | 0.43 | 0.24 | 0.46 | 0.019 | 0.054 | 0.0008 | 0.005 | 0.0027 | 0.0046 |
| 38. | Invented example | 0.44 | 0.25 | 0.45 | 0.022 | 0.049 | 0.0012 | 0.009 | 0.0021 | 0.0043 |
| 39. | Comparative example | 0.46 | 0.24 | 0.47 | 0.019 | 0.059 | 0.0020 | 0.016 | 0.0013 | 0.0055 |
| 40. | Comparative example | 0.43 | 0.26 | 0.44 | 0.024 | 0.053 | 0.0026 | 0.024 | 0.0015 | 0.0048 |

| Sample No. | Classification | Average aspect ratio | Maximum aspect ratio | Maximum MnS grain size | Number of MnS grains | Hardness after natural cooling HV | Hot critical strain % | Remarks |
|---|---|---|---|---|---|---|---|---|
| 2. | Invented example | 3.8 | 17.3 | 10.4 | 420 | 224 | 92 | 0.05% S |
| 27. | Invented example | 4.2 | 14.5 | 17.6 | 405 | 221 | 94 | |
| 38. | Invented example | 3.1 | 18.6 | 16.5 | 401 | 224 | 92 | |
| 39. | Comparative example | 7.2 | 32.1 | 25.7 | 315 | 219 | 88 | |
| 40. | Comparative example | 12.5 | 38.6 | 30.1 | 126 | 220 | 85 | |

Table 6 shows the examples wherein the influences of the other elements are examined. The methods of preparing the test pieces and evaluating the hot workability and machin-

TABLE 6

| Sample No. | Classification | Chemical composition C | Si | Mn | P | S | Al | total D | total N | Zr | Cr | Ni |
|---|---|---|---|---|---|---|---|---|---|---|---|---|
| 41. | Invented example | 0.43 | 0.23 | 0.30 | 0.011 | 0.059 | 0.002 | 0.0025 | 0.0052 | 0.0022 | 0.25 | |
| 42. | Comparative example | 0.45 | 0.22 | 0.30 | 0.022 | 0.055 | 0.005 | 0.0027 | 0.0042 | <0.0002 | 0.24 | |
| 43. | Invented example | 0.42 | 0.23 | 0.35 | 0.025 | 0.051 | 0.008 | 0.0021 | 0.0049 | 0.0018 | 0.21 | 0.25 |
| 44. | Comparative example | 0.42 | 0.22 | 0.35 | 0.023 | 0.052 | 0.006 | 0.0024 | 0.0042 | <0.0002 | 0.20 | 0.31 |
| 45. | Invented example | 0.43 | 1.22 | 0.32 | 0.012 | 0.054 | 0.002 | 0.0027 | 0.0046 | 0.0062 | | |
| 46. | Comparative example | 0.45 | 1.25 | 0.32 | 0.018 | 0.049 | 0.004 | 0.0024 | 0.0042 | <0.0002 | | |
| 47. | Invented example | 0.45 | 0.22 | 0.41 | 0.023 | 0.059 | 0.005 | 0.0027 | 0.0043 | 0.0081 | | |
| 48. | Comparative example | 0.46 | 0.19 | 0.41 | 0.022 | 0.053 | 0.006 | 0.0021 | 0.0055 | <0.0002 | | |
| 49. | Invented example | 0.42 | 0.17 | 0.50 | 0.019 | 0.052 | 0.005 | 0.0022 | 0.0048 | 0.0025 | | |
| 50. | Comparative example | 0.42 | 0.19 | 0.50 | 0.023 | 0.052 | 0.005 | 0.0024 | 0.0045 | <0.0002 | | |
| 51. | Invented example | 0.43 | 0.22 | 0.45 | 0.026 | 0.048 | 0.002 | 0.0019 | 0.0055 | 0.0021 | | |
| 52. | Comparative example | 0.41 | 0.25 | 0.45 | 0.027 | 0.052 | 0.006 | 0.0024 | 0.0055 | <0.0002 | | |
| 53. | Invented example | 0.48 | 0.46 | 0.28 | 0.025 | 0.054 | 0.009 | 0.0023 | 0.0046 | 0.0009 | | |
| 54. | Comparative example | 0.47 | 0.45 | 0.28 | 0.021 | 0.049 | 0.004 | 0.0021 | 0.0047 | <0.0002 | | |
| 55. | Invented example | 0.34 | 0.83 | 0.54 | 0.022 | 0.059 | 0.009 | 0.0024 | 0.0043 | 0.0018 | | |
| 56. | Comparative example | 0.35 | 0.85 | 0.54 | 0.025 | 0.052 | 0.002 | 0.0027 | 0.0055 | <0.0002 | | |
| 57. | Invented example | 0.32 | 0.19 | 0.36 | 0.025 | 0.054 | 0.003 | 0.0021 | 0.0048 | 0.0023 | | |
| 58. | Comparative example | 0.34 | 0.22 | 0.36 | 0.026 | 0.049 | 0.002 | 0.0024 | 0.0055 | <0.0002 | | |
| 59. | Invented example | 0.48 | 0.30 | 0.38 | 0.022 | 0.059 | 0.005 | 0.0027 | 0.0052 | 0.0040 | | |
| 60. | Comparative example | 0.46 | 0.27 | 0.38 | 0.023 | 0.053 | 0.002 | 0.0018 | 0.0052 | <0.0002 | | |

| Sample No. | Classification | Chemical composition Ti | V | Nb | Mo | B | Pb | Si | Te | Ca | Mg |
|---|---|---|---|---|---|---|---|---|---|---|---|
| 41. | Invented example | | | | | | | | | | |
| 42. | Comparative example | | | | | | | | | | |
| 43. | Invented example | 0.028 | | | | | | | | | |
| 44. | Comparative example | 0.025 | | | | | | | | | |
| 45. | Invented example | 0.017 | | | | | | | | | |
| 46. | Comparative example | 0.015 | | | | | | | | | |
| 47. | Invented example | | 0.21 | | | | | | | | |
| 48. | Comparative example | | 0.21 | | | | | | | | |
| 49. | Invented example | | | 0.051 | | | | | | | |
| 50. | Comparative example | | | 0.042 | | | | | | | |
| 51. | Invented example | | | | 0.22 | | | | | | |
| 52. | Comparative example | | | | 0.25 | | | | | | |
| 53. | Invented example | 0.025 | | | 0.11 | 0.0026 | | | | | |
| 54. | Comparative example | 0.022 | | | 0.11 | 0.0024 | | | | | |
| 55. | Invented example | | | | | | 0.15 | | | | |

TABLE 6-continued

| | | | | | | | | | | | | |
|---|---|---|---|---|---|---|---|---|---|---|---|---|
| 56. | Comparative example | | | | | | | 0.16 | | | | |
| 57. | Invented example | 0.056 | | | | | | | | | 0.0013 | |
| 58. | Comparative example | 0.058 | | | | | | | | | 0.0015 | |
| 59. | Invented example | | 0.10 | 0.02 | | | | | | 0.0019 | 0.0014 | |
| 60. | Comparative example | | 0.12 | 0.03 | | | | | | 0.0031 | 0.0013 | |

TABLE 6-1

| Sample | | Chemical composition | | | | | | | | | | |
|---|---|---|---|---|---|---|---|---|---|---|---|---|
| No. | Classification | C | Si | Mn | P | S | Al | total D | total N | Zr | Cr | Ni |
| 61. | Invented example | 0.44 | 0.36 | 0.46 | 0.018 | 0.052 | 0.006 | 0.0024 | 0.0036 | 0.0019 | | |
| 62. | Comparative example | 0.43 | 0.32 | 0.46 | 0.019 | 0.044 | 0.007 | 0.0027 | 0.0036 | <0.0002 | | |
| 63. | Invented example | 0.84 | 0.34 | 0.46 | 0.022 | 0.052 | 0.008 | 0.0026 | 0.0038 | 0.0029 | | |
| 64. | Comparative example | 0.45 | 0.34 | 0.46 | 0.021 | 0.044 | 0.005 | 0.0024 | 0.0038 | <0.0002 | | |
| 65. | Invented example | 0.42 | 0.24 | 0.32 | 0.016 | 0.049 | 0.004 | 0.0027 | 0.0046 | 0.0059 | | |
| 66. | Comparative example | 0.40 | 0.25 | 0.32 | 0.018 | 0.059 | 0.008 | 0.0021 | 0.0046 | <0.0002 | | |
| 67. | Invented example | 0.41 | 0.24 | 1.01 | 0.022 | 0.050 | 0.003 | 0.0018 | 0.0048 | 0.0054 | | |
| 68. | Comparative example | 0.44 | 0.23 | 1.02 | 0.019 | 0.052 | 0.004 | 0.0023 | 0.0054 | <0.0002 | | |
| 69. | Invented example | 0.46 | 0.24 | 1.22 | 0.014 | 0.053 | 0.004 | 0.0028 | 0.0043 | 0.0055 | 0.11 | |
| 70. | Comparative example | 0.45 | 0.23 | 1.25 | 0.019 | 0.057 | 0.004 | 0.0027 | 0.0055 | <0.0002 | 0.11 | |
| 71. | Invented example | 0.44 | 0.21 | 1.20 | 0.012 | 0.051 | 0.004 | 0.0018 | 0.0063 | 0.0075 | | |
| 72. | Comparative example | 0.46 | 0.20 | 1.21 | 0.015 | 0.049 | 0.003 | 0.0022 | 0.0045 | <0.0002 | | |
| 73. | Invented example | 0.23 | 0.25 | 0.80 | 0.027 | 0.054 | 0.004 | 0.0021 | 0.0048 | 0.0009 | | |
| 74. | Comparative example | 0.24 | 0.22 | 0.74 | 0.021 | 0.049 | 0.005 | 0.0022 | 0.0052 | <0.0002 | | |
| 75. | Invented example | 0.35 | 0.19 | 0.41 | 0.024 | 0.052 | 0.008 | 0.0018 | 0.0038 | 0.0035 | | |
| 76. | Comparative example | 0.36 | 0.21 | 0.45 | 0.027 | 0.054 | 0.008 | 0.0021 | 0.0052 | <0.0002 | | |
| 77. | Invented example | 0.60 | 0.29 | 0.63 | 0.024 | 0.057 | 0.007 | 0.0020 | 0.0047 | 0.0049 | | |
| 78. | Comparative example | 0.60 | 0.32 | 0.62 | 0.021 | 0.053 | 0.008 | 0.0022 | 0.0045 | <0.0002 | | |
| 79. | Comparative example | 0.45 | 0.32 | 0.65 | 0.024 | 0.052 | 0.007 | 0.0221 | 0.0041 | 0.0056 | | |
| 80. | Comparative example | 0.44 | 0.36 | 0.62 | 0.022 | 0.056 | 0.008 | 0.0021 | 0.0241 | 0.0081 | | |

| Sample | | Chemical composition | | | | | | | | | |
|---|---|---|---|---|---|---|---|---|---|---|---|
| No. | Classification | Ti | V | Nb | Mo | B | Pb | Si | Te | Ca | Mg |
| 61. | Invented example | | | | | | | 0.12 | | | |
| 62. | Comparative example | | | | | | | 0.11 | | | |
| 63. | Invented example | | 0.25 | | | | | | 0.0021 | 0.0014 | 0.0020 |
| 64. | Comparative example | | 0.21 | | | | | | 0.0021 | 0.0015 | 0.0020 |
| 65. | Invented example | 0.011 | | | | | | | | | 0.0041 |
| 66. | Comparative example | 0.011 | | | | | | | | | 0.0045 |
| 67. | Invented example | 0.014 | | | | | | | 0.0019 | 0.0012 | |

TABLE 6-1-continued

| | | | | | | |
|---|---|---|---|---|---|---|
| 68. | Comparative example | 0.013 | | | 0.0021 | 0.0013 |
| 69. | Invented example | 0.014 | 0.10 | | 0.0018 | 0.0013 |
| 70. | Comparative example | 0.013 | 0.11 | | 0.0022 | 0.0015 |
| 71. | Invented example | 0.018 | | 0.03 | | |
| 72. | Comparative example | 0.014 | | 0.04 | | |
| 73. | Invented example | | | | | |
| 74. | Comparative example | | | | | |
| 75. | Invented example | | 0.21 | | | |
| 76. | Comparative example | | 0.25 | | | |
| 77. | Invented example | | | | | |
| 78. | Comparative example | | | | | |
| 79. | Comparative example | | | | | |
| 80. | Comparative example | | | | | |

TABLE 6-2

| Sample No. | Classification | Average aspect ratio | Maximum aspect ratio | Maximum MnS grain size | Number of MnS grains | Hot critical strain % | VL 1000 |
|---|---|---|---|---|---|---|---|
| 41. | Invented example | 3.5 | 16.0 | 15.7 | 515 | 94 | 19 |
| 42. | Comparative example | 11.9 | 47.8 | 33.0 | 198 | 86 | 12 |
| 43. | Invented example | 3.9 | 21.5 | 16.9 | 514 | 94 | 18 |
| 44. | Comparative example | 13.3 | 44.5 | 19.8 | 202 | 91 | 11 |
| 45. | Invented example | 4.1 | 13.7 | 17.3 | 546 | 94 | 20 |
| 46. | Comparative example | 11.3 | 36.1 | 27.4 | 292 | 90 | 16 |
| 47. | Invented example | 3.4 | 18.1 | 15.2 | 401 | 94 | 22 |
| 48. | Comparative example | 8.6 | 43.7 | 38.8 | 261 | 88 | 12 |
| 49. | Invented example | 5.0 | 17.8 | 15.4 | 612 | 94 | 22 |
| 50. | Comparative example | 10.6 | 45.5 | 18.4 | 284 | 90 | 9 |
| 51. | Invented example | 6.6 | 11.3 | 18.8 | 474 | 94 | 15 |
| 52. | Comparative example | 8.7 | 49.3 | 18.5 | 288 | 89 | 8 |
| 53. | Invented example | 5.1 | 22.8 | 15.6 | 407 | 94 | 15 |
| 54. | Comparative example | 10.6 | 49.7 | 31.5 | 265 | 90 | 8 |
| 55. | Invented example | 5.6 | 11.5 | 17.8 | 560 | 92 | 45 |
| 56. | Comparative example | 9.3 | 48.8 | 33.2 | 196 | 82 | 43 |
| 57. | Invented example | 6.1 | 20.0 | 19.6 | 545 | 94 | 42 |
| 58. | Comparative example | 9.7 | 42.1 | 35.8 | 223 | 88 | 40 |
| 59. | Invented example | 6.9 | 20.4 | 15.4 | 650 | 94 | 42 |
| 60. | Comparative example | 13.5 | 35.1 | 37.9 | 195 | 89 | 41 |

TABLE 6-3

| Sample No. | Classification | Average aspect ratio | Maximum aspect ratio | Maximum MnS grain size | Number of MnS grains | Hot critical strain % | VL 1000 |
|---|---|---|---|---|---|---|---|
| 61. | Invented example | 4.8 | 11.9 | 16.7 | 512 | 94 | 44 |
| 62. | Comparative example | 8.5 | 49.6 | 24.8 | 242 | 88 | 43 |
| 63. | Invented example | 3.7 | 12.9 | 15.6 | 615 | 94 | 45 |
| 64. | Comparative example | 10.9 | 49.9 | 34.5 | 305 | 88 | 44 |
| 65. | Invented example | 4.5 | 22.6 | 19.1 | 545 | 94 | 18 |
| 66. | Comparative example | 13.8 | 45.6 | 28.4 | 240 | 88 | 10 |
| 67. | Invented example | 3.9 | 15.2 | 16.9 | 379 | 92 | 48 |
| 68. | Comparative example | 9.5 | 35.7 | 29.2 | 214 | 91 | 40 |
| 69. | Invented example | 5.3 | 15.1 | 18.7 | 526 | 94 | 47 |
| 70. | Comparative example | 12.7 | 31.9 | 24.8 | 212 | 90 | 42 |
| 71. | Invented example | 5.5 | 22.6 | 18.8 | 374 | 92 | 27 |
| 72. | Comparative example | 8.9 | 49.4 | 29.0 | 271 | 85 | 12 |
| 73. | Invented example | 3.7 | 12.2 | 18.2 | 576 | 95 | 56 |
| 74. | Comparative example | 14.3 | 45.4 | 25.9 | 208 | 91 | 54 |
| 75. | Invented example | 5.3 | 18.3 | 15.3 | 466 | 95 | 46 |
| 76. | Comparative example | 8.8 | 39.1 | 25.2 | 208 | 90 | 42 |
| 77. | Invented example | 3.3 | 12.2 | 17.2 | 431 | 94 | 18 |
| 78. | Comparative example | 12.9 | 31.5 | 20.0 | 217 | 84 | 11 |
| 79. | Comparative example | 10.1 | 39.2 | 21.7 | 204 | 82 | 10 |
| 80. | Comparative example | 6.6 | 20.8 | 16.6 | 512 | 84 | 11 |

Figure 10:
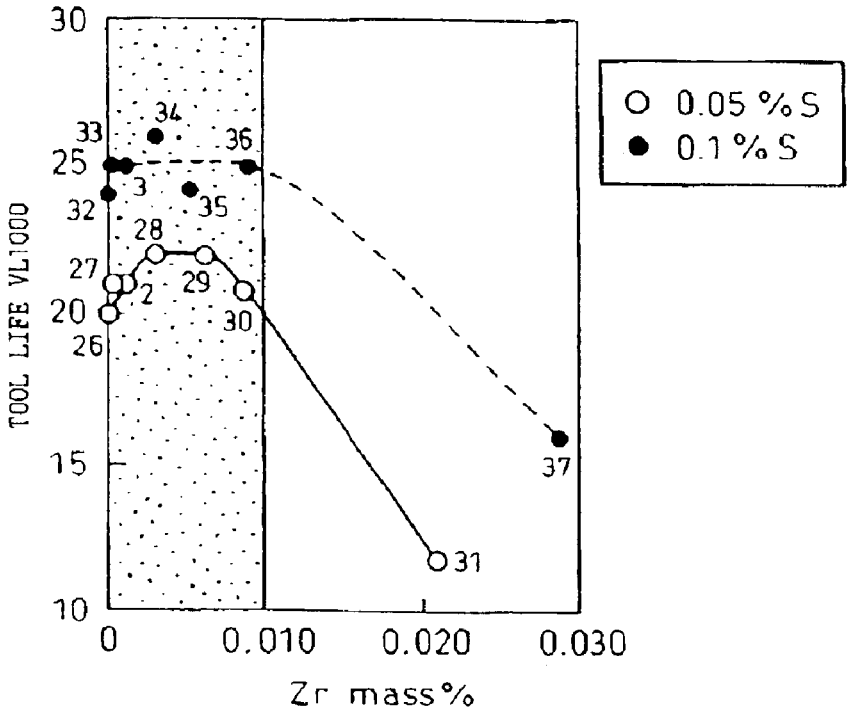
FIG. 10 is a graph showing the influence of Zr content on the service life of a cutting tool.

FIG. 10 shows the result of evaluating the adverse effects to machinability in terms of VL1000 (the maximum cutting speed at which a drill can be used up to a cumulative drilling depth of 1,000 mm without drill change), an indicator of the service life of a drill. It is clear in the figure that, when Zr is added in a large amount, machinability is deteriorated. It is also clear, from FIG. 8, that an excessive addition of Zr leads to the formation of the clusters of ZrN, ZrS and so on and causes impact values to lower, although the aspect ratio of MnS grains is good. Note that the numerals in FIGS. 4 to 10 correspond to the example numbers.

INDUSTRIAL APPLICABILITY

The present invention makes it possible to provide a steel excellent in all of hot workability, mechanical properties and machinability by virtue of the measures explained hereinbefore. In particular, the technology of the present invention is effectively applicable to both heat-treated and non-heat-treated steels because it is not significantly influenced by a heat treatment, a microstructure and so on and is based on the control of the shape of sulfide grains. With respect to workability too, the present invention is effective not only for hot forging but also for cold forging, and, therefore, it is effective for a wide variety of steels of which good forging workability, mechanical properties and machinability are required.

What is claimed is:

1. An as-hot rolled or as-hot forged steel bar or rod excellent in forgeability and machineability, characterized in that; the steel bar or rod has a composition consisting essentially of, in mass %, C: 0.1–0.85%, Si: 0.01–1.5%, Mn: 0.05–2.0%, P: 0.003–0.2%, S: 0.003–0.5%, and Zr: 0.0003–0.01%, and Al, total O and total N are controlled in the respective ranges Al: 0.01% or less, total O: 0.02% or less, and total N: 0.0063% or less, and the average aspect ratio of MnS particles is 10 or less and the maximum aspect ratio of MnS particles is 30 or less; and the maximum particle size ($\mu$m) of MnS is equal to less than 110×[S %]+15 and the number of the MnS particles per $mm^2$ is not greater than 1657; and the balance of the steel components being Fe and unavoidable impurities.

2. An as-hot rolled or as-hot forged steel bar or rod according to claim 1, wherein the steel bar or rod further has a composition consisting essentially of one or more of Cr: 0.01–2.0%, Ni: 0.05–2.0%, Mo: 0.05–1.0%, V: 0.05–1.0%, Nb: 0.005–0.2%, Ti: 0.005–0.1%, Ca: 0.0002–0.005%, Mg: 0.0003–0.005%, Te: 0.0003–0.005%, Bi: 0.05–0.5%, Pb: 0.01–0.5%, or B: 0.0005%–0.004%.

3. An as-hot rolled or as-hot forged steel bar or rod according to claim 1 wherein the Zr content is 0.0003 to 0.0099%.

4. An as-hot rolled or as-hot forged steel bar or rod according to claim 1, wherein the Zr content is 0.0005 to 0.0050%.

5. An as-hot rolled or as-hot forged steel bar or rod according to claim 1, 2, 3 or 4, wherein the maximum number of MnS particles per $mm^2$ is 800.

6. An as-hot rolled or as-hot forged steel bar or rod according to claim 1, 2, 3 or 4, wherein the P content is 0.011 to 0.2%.

7. An as-hot rolled or as-hot forged steel bar or rod according to claim 1, 2, 3 or 4, wherein the maximum particle size ($\mu$m) of MnS is not greater than 25.8.

8. An as-hot rolled or as-hot forged steel bar or rod according to claim 1, 2, 3 or 4, wherein total Al is 0.009% or less.

9. An as-hot rolled or as-hot forged steel bar or rod according to claim 6, wherein total Al is 0.009% or less.

10. An as-hot rolled or as-hot forged steel bar or rod according to claim 1, 2, 3, or 4, wherein hardness after natural cooling is in a range of 210 HV to 291 HV.

11. An as-hot rolled or as-hot forged steel bar or rod according to claim 6, wherein hardness after natural cooling is in a range of 210 HV to 291 HV.

12. An as-hot rolled or as-hot forged steel bar or rod according to claim 1, 2, 3 or 4, wherein hardness after annealing is in a range of 158 HV to 164 HV.

13. An as-hot rolled or as-hot forged steel bar or rod according to claim 6, wherein hardness after annealing is in a range of 158 HV to 164 HV.

14. An as-hot rolled or as-hot forged steel bar or rod according to claim 1, 2, 3 or 4, wherein impact value $J/cm^2$ in a longitudinal direction is in a range of 97 to 134 and in a sectional direction is in a range of 26 to 60.

15. An as-hot rolled or as-hot forged steel bar or rod according to claim 6, wherein impact value $J/cm^2$ in a longitudinal direction is in a range of 97 to 134 and in a sectional direction is in a range of 26 to 60.

16. An as-hot rolled or as-hot forged steel bar or rod according to claim 1, 2, 3 or 4, wherein total N is 0.0046% or less.

17. An as-hot rolled or as-hot forged steel bar or rod according to claim 6, wherein total N is 0.0046% or less.

18. An as-hot rolled or as-hot forged steel bar or rod according to claim 1, 2, 3 or 4, wherein the steel bar or rod is a non-heat-treated steel.

19. An as-hot rolled or as-hot forged steel bar or rod according to claim 6, wherein in the steel bar or rod is non-heat-treated steel.

20. An as-hot rolled or as-hot forged steel bar or rod according to claim 12, wherein the steel bar or rod has been subjected to softening annealing.

21. An as-hot rolled or as-hot forged steel bar or rod according to claim 13, wherein the steel bar or rod has been subjected to softening annealing.

* * * * *